United States Patent [19]

Wyatt

[11] Patent Number: 4,964,191

[45] **Date of Patent: * Oct. 23, 1990**

[54] CARRIER AND REPLACEABLE CARTRIDGE HANGER ASSEMBLY

[75] Inventor: James L. Wyatt, Los Angeles, Calif.

[73] Assignee: Ambassador Industries, Los Angeles, Calif.

[ * ] Notice: The portion of the term of this patent subsequent to Dec. 24, 2002 has been disclaimed.

[21] Appl. No.: 177,565

[22] Filed: Apr. 4, 1988

[51] Int. Cl.[5] ..... E05D 13/02

[52] U.S. Cl. ..... 16/87.2; 160/177

[58] Field of Search ..... 16/87.2, 102; 160/166.1, 167, 168.1, 174, 176.1, 177

[56] References Cited

U.S. PATENT DOCUMENTS

| | | | |
|---|---|---|---|
| 4,122,884 | 10/1978 | Salzmann | 160/168 R |
| 4,306,608 | 12/1981 | Frentzel et al. | 160/176 R |
| 4,316,493 | 2/1982 | Arena | 160/168 R |
| 4,386,644 | 6/1983 | Debs | 160/174 |
| 4,425,955 | 1/1984 | Kaucic | 160/168 R |
| 4,425,956 | 1/1984 | Terlecke | 160/168 R |
| 4,559,670 | 12/1985 | Wyatt | 16/87.2 |
| 4,616,688 | 10/1986 | Agos | 160/176 R |
| 4,628,981 | 12/1986 | Ciriaci et al. | 160/168 R |
| 4,675,939 | 6/1987 | Fukada | 16/87.2 |
| 4,759,397 | 7/1988 | Walther | 160/166.1 |

*Primary Examiner*—Richard K. Seidel
*Assistant Examiner*—Edward A. Brown
*Attorney, Agent, or Firm*—Jessup, Beecher & Slehofer

[57] ABSTRACT

A vertical blind system installed over a window area has a plurality of carrier and hanger assembly units, each of which has a vertical louver or vane suspended from it. The unit has two major subcomponents. They are a frame having a chamber, and a replaceable, manually insertable cartridge having a pendant member for holding the individual blind. The frame has a top circular bearing and a resilient retaining clip which holds the cartridge in position in the chamber. Whenever the cartridge becomes broken, the service technician can quickly snap out the broken cartridge and reinsert a new one. This can be done without the inconvenience and time consuming task of dismantling the entire vertical blind system to repair a single carrier and hanger assembly unit.

7 Claims, 3 Drawing Sheets

CARRIER AND REPLACEABLE CARTRIDGE HANGER ASSEMBLY

BACKGROUND OF THE INVENTION

Vertical vane or louver hanger assemblies are well-known in the art and are a common fixture in households and office buildings. Each vertical vane is usually 3½ inches wide and is hung from a hanger assembly inside a carrier which rides on a track in the head rail. In a typical installation, 10–30 vertical vanes and their supporting carriers and hanger assemblies are hung on a head rail. Each carrier and hanger assembly unit rides on wheels in the head rail. There is also a splined pinion rod through which the carrier hanger assembly units are held in place and along which the carriers and hanger assembly units move back and forth on this splined pinion rod There is also a looped hanging chain at one end which, when pulled by the user, rotates the pinion rod causing the vertical vanes to rotate about their vertical axes in unison with one another.

The vertical louver or vane carrier and assembly units as described in the Wyatt patent 4,559,670 have an individual vane adjustment feature. By twisting the vertically hung vane, that particular vane can be positioned individually and independently of the other hanging vanes. In this way, the occupant of an office building or a dwelling in which the blind system is installed can customize the orientation of the faces of the vanes to one's personal preference. Oftentimes the louvers, vanes or slats, have to be adjusted and oriented individually to compensate for bright sunlight and the like.

The vertical vanes can be adjusted individually as disclosed in 4,559,670 by twisting the individual vane, or in unison by pulling on the side chain. Either way, each vane can be rotated 180 degrees for complete control of the entering light, ventilation or for privacy.

An additional feature of a typical vertical blind system, is that the vanes can be drawn and stacked to the sides of the window casing to provide for an unrestricted view through the window if desired. In effect, the vertical blind system functions like a drapery system, with the added versatility of allowing adjustment of the vanes about their vertical axes. Over a period of time the clips holding the vanes become brittle, and one or more of them breaks off. This is probably due to heat, which over a period of time evaporates one or more volatile compounds from the DELRIN 500 plastic from which the plastic components are made, leaving a brittle shell. This is most prevalent in installations where a headrail is mounted under a valance in a sunny climate. Temperatures can reach nearly 200 degrees in these enclosed box spaces in areas like Palm Springs or Las Vegas. When a clip breaks off, it must be replaced.

In the prior art, when an individual hanger assembly becomes broken or damaged, then the entire head rail assembly has to be dismantled from the casing and each carrier and hanger assembly unit taken off the pinion rod so that the replacement carrier and hanger assembly unit can be put back in into its proper sequence.

The inventor saw the inconvenience and time consuming procedure of removing and dismantling the entire vertical blind system to replace one individual or several hanger assemblies. Accordingly, the inventor invented a detachable cartridge assembly which snaps in and snaps out of place into the carrier for the hanger assembly This cartridge assembly comprises the portion which is most prone to damage and breakdown. By having a replaceable cartridge assembly, the repairman can simply stand on a ladder to reach the top of the head rail to remove the louver or vane, snap out the damaged cartridge assembly, replace it with a new undamaged one which is snapped into place, and then re-attaching the vertical vane to the cartridge assembly.

SUMMARY OF THE INVENTION

The carrier and replaceable cartridge hanger assembly unit for a vertical louver, vane or slat, has two major subcomponents. One is the frame or housing which is comprised of a molded one-piece unit having a top and bottom and a vertical cavity, or chamber. The other major subcomponent is a cartridge. The cartridge hanger assembly can be quickly inserted, loaded or snapped into place into the vertical cavity or chamber of the frame. The insertable cartridge can also be easily removed from the cavity. The purpose of this ability to quickly insert and remove the cartridge is for ease in servicing the unit after it is installed in a vertical blind system over a window of a residence or office building. The insertable cartridge includes a vertical pendant member to which is secured a stem gear and a toothed crown ring. The stem gear cooperates with a horizontally positioned worm gear inside the frame. The purpose of these two gears (stem and worm) meshing is so that when the worm gear rotates, the stem gear also rotates thereby causing the vertical pendant member to rotate. The slat, louver, or vane which is suspended from the pendant member in turn rotates about its vertical axis. The whole purpose of this rotational ability is to adjust or alter the facial orientation of each vertical louver. When the individual carrier and hanger assembly unit is installed in a vertical blind system, there are routinely several units placed in a head railing. A pinion rod is also positioned horizontally so that the worm gear of each unit is slid over and cooperates with the pinion rod. The occupant of the room in which the vertical blind system has been installed can pull a looped chain which rides on a sprocket wheel which is attached to one end of the pinion rod. By pulling up or down on the chain, the sprocket wheel causes the pinion rod and each pendant member to rotate, thereby changing the orientation of the louvers in unison. Each individual unit, by means of the insertable cartridge, has a further feature of allowing the occupant to individually change the facial orientation of a given louver or vane independently of the other louvers hanging in the rail system. This can be accomplished by the operator grasping the pendant member with his fingers pushing the stem up to partially disengage the teeth on the crown ring from the lands, or spaces, in the stem gear and applying torque to twist the pendant member. The twisting causes the toothed crowned ring, which is in combination with the stem gear, to twist even though the stem gear remains stationary, since it is meshed with the worm gear. The twisting causes the teeth of the toothed crown ring to disengage from the tooth spaces in the stem gear. This allows the pendant member to turn independently of the stem gear which is stationary. The twisting and disengagement of the toothed crown ring from the stem gear allows the pendant member to rotate in increments, or at about 40 degree intervals.

The pendant member includes an enlarged end or bulbous tip having a pair of secant flats cut away on either side below it. The purpose of this tip and the two secant flats is to provide a lock on coupling for the toothed crown ring. The toothed crown ring has a radial passageway further having an elliptical shaped passageway towards its lower end. The toothed crown ring is sufficiently resilient and so is the enlarged bulbous tip so that the tip can be passed through the elliptical passage until it engages with the pair of secant flats thereby locking the toothed crown journal to the pendant member. Prior to this coupling, however, the stem gear is positioned on the vertical stem of the pendant member. There is a slight amount of clearance between the top of the stem gear and the teeth projecting downward from the toothed crown ring so that the twisting of the pendant member allows sufficient clearance for the teeth to temporarily disengage with the gear spaces on the stem gear. However, the flexing of the teeth forces the teeth and the spaces, or lands, between the stem gear to reengage as soon as they realign. This combination of the bulbous end of the vertical stem and the stem gear and the toothed crown ring snapped over the top of the stem gear is in effect a clutch mechanism for providing temporary disengagement of the stem gear so that the pendant member and the hanging vertical vane or louver can be adjusted in 40 degree increments independently of the other hanging louvers or vanes.

Unfortunately, the adjustment feature and heat degradation of the plastic material results in eventual breakdown and failure of the pendant member, or stem clip. Prior to this invention, whenever a particular hanger assembly unit became disabled, the entire rail system had to be disassembled and each carrier and assembly unit had to be removed to get to the broken assembly unit. Then the assembly unit had to be rebuilt, replacing the broken parts and reinstalling the unites on the railing system. The quickly replaceable snap-in cartridge of the present invention allows for this entire subassembly to be removed from the unit without the need to disassemble the entire system.

The snap-in cartridge is held in place by two features on the frame which are a top circular bearing on the top of the frame and a retaining clip having a pair of resilient arms at the bottom of the frame. The toothed crown ring has a circular top so that it mates with the circular bearing cut out in the top of the frame and at the same time the cylindrical journal extension which is the lower portion of the stem gear mates and matches up with the resilient retaining clip. When the cartridge is inserted into the vertical cavity of the frame, both arms of the retaining clip will spread out and expand around the circular journal extension of the stem gear to allow the cartridge to snap into position in the chamber or vertical cavity of the carrier frame.

Accordingly, it is the object of this invention to provide a carrier and hanger assembly unit for a vertical blind system which has a quick release cartridge forming the hanger assembly which suspends the individual vertical louvers or vanes so that the cartridge can be easily removed and replaced with a new one in the event of breakage of the pendant member without requiring the disassembly of the entire vertical blind system.

It is a further object of this invention to provide a clutch mechanism within the quick release cartridge for allowing for rotational adjustment in incremental units of the individual louver or vane suspended from the cartridge for changing the angular orientation of the vertical slat about its vertical axis.

It is yet a further object of this invention to provide a clutch mechanism which allows for the changing of the orientation of the pendant member having a toothed crown ring in combination with a vertical stem gear, both of which are attached to a pendant member, all three parts forming the snap-in cartridge subassembly.

It is yet a further object of this invention to provide a means for limiting the adjustment of the orientation of the face of the vertical louver or vane to 180 degrees or less.

DETAILED DESCRIPTION OF THE PREFERRED EMBODIMENT

Figure 5:
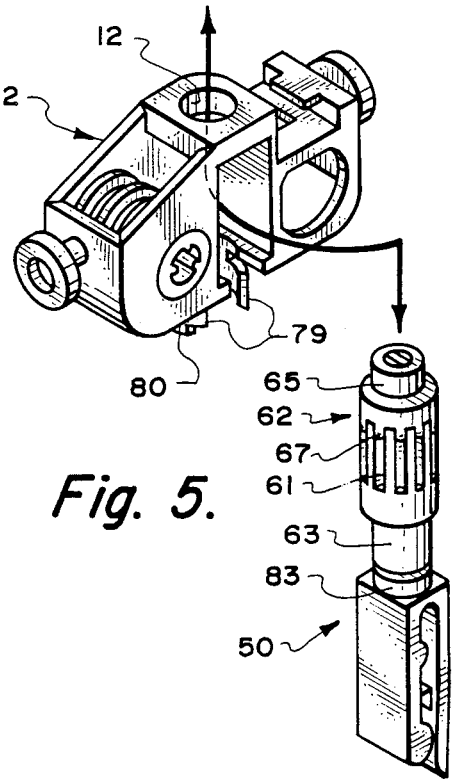
FIG. 5 is a perspective view showing the perspective view of the carrier and the snap-in cartridge hanger assembly detached from the carrier.
Figure 6:
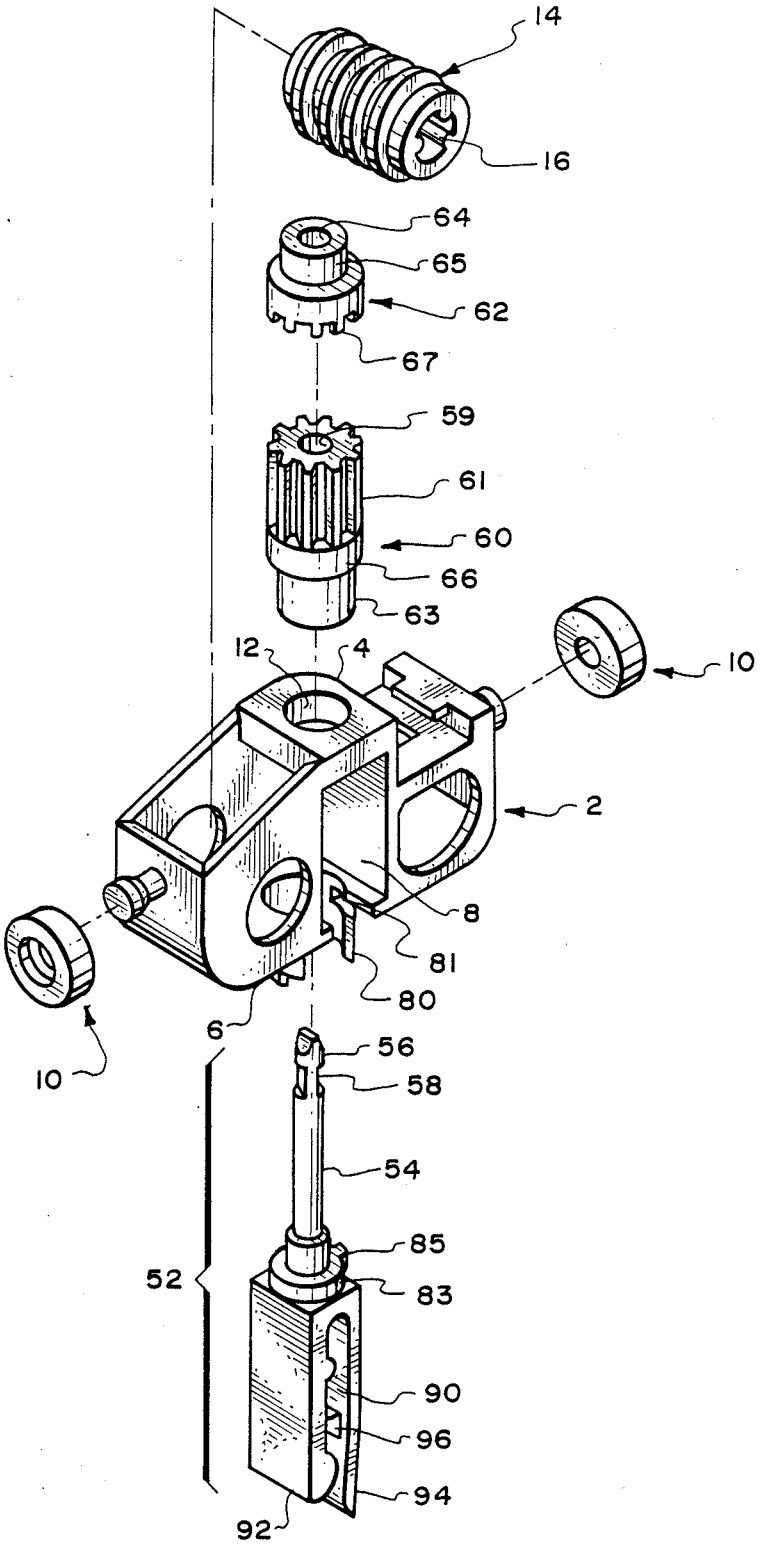
FIG. 6 is an exploded perspective view showing the two major components; the carrier and the cartridge hanger assembly.

Referring now to FIG. 6 there is an exploded perspective view showing the seven molded pieces comprising the invention. FIG. 5 also discloses, in perspective view, the two components when combined together comprise the present invention. The two major components are the frame means 2 and the cartridge hanger assembly 50. The cartridge hanger assembly 50 is insertable into and separable from the frame means 2. The purpose of this manually insertable, snap-in, replaceable cartridge hanger assembly 50 is to easily repair a carrier and hanger assembly unit which has a damaged hanger assembly.

Referring back now to FIG. 6, the frame means 2 is further defined as having a top surface 4, a bottom surface 6 and a vertical cavity 8. The vertical cavity, or chamber 8, is the cavity into which the hand insertable, snap-in cartridge hanger assembly 50 is positioned. The frame means additionally has a pair of wheels 10 for allowing the frame means 2 illustrated as a frame to pass back and forth in the rail system 3. On the top surface 4 of the frame means, there is further defined a circular bearing means illustrated as a bearing 12. The frame means further has a worm gear means 14 illustrated as a worm gear positioned horizontally within the frame means. The worm gear 14 has a central bore 16 which is adapted to slide along a pinion rod 1 on which all the series of vertical carrier assemblies slide back and forth on. The pinion rod 1 can be rotated causing the worm gear 14 to rotate. This in turn changes the angular orientation of the hanging vertical louver or vane about its vertical axis.

FIG. 6 illustrates the snap-in cartridge hanger assembly 50 disassembled. The cartridge assembly 50 generally comprises an elongate pendant member 52 which is the major subcomponent and which holds the vertical louver 5 or vane. The pendant member further is defined as having a vertical stem means 54 illustrated as a vertical stem extending upwardly from the hanger portion and terminating with an enlarged end 56 and a pair of secant flats 58 cut out below this enlarged end 56. There is a stem gear 60 which can pass over and cooperates with the vertical stem 54. The enlarged end or bulbous tip 56 of the stem has attached to it a toothed crown ring 62 which has an elliptical shaped radial passage 64. This radial passage 64 is expandable so that it can slip over the enlarged end 56 of the vertical stem 54 and the crown ring snaps into place and cooperates with the pair of secant flats 58. When the manually insertable, snap-in cartridge assembly 50 is in the assembled position, there is the elongate pendant member 52, the stem gear 60 and the toothed crown ring 62 snapped on at the end. The cartridge hanger assembly comprises three separate pieces.

On the bottom surface 6 of the frame 2 there is a resilient retaining clip 80. The purpose of this open retaining clip 80 and the circular bearing 12 is to hold and maintain the snap-in cartridge assembly 50 in position after it has been snapped into place. The circular top 65 of the toothed crown ring 62 cooperates with the circular bearing means 12 and holds the upper portion of the cartridge 50 in place. The lower portion of the cartridge 50 is held in place by the resilient open retaining clip 80 which expands when the cartridge is forced into the vertical cavity 8. The clip expands and contracts because of its resiliency. The stem gear 60 has a lower cylindrical journal portion 63 axially aligned as part of the stem gear. The circumference of the cylindrical journal 82 is of a sufficient dimension so that it is firmly held in place by the resilient open retaining clip 80 when the retaining clip is not in a stressed position. The stem gear has a radial bore 59.

The elongate pendant member 52 is made of a resilient material, and it has a longitudinal slot 90 formed by a pair of parallel fingers 92 and 94. The finger 94 has a ledge 96 extending substantially across the slot and an upwardly extending ridge 97 on the edge of the ledge 96 adjacent to the other finger. The other finger 92 has a boss 98 extending into the slot below the ledge. This provides a securing point so that the vertical louver 5 which has a slot 7 can be inserted into the longitudinal slot 90 and hooked over and behind the ledge and thus held in place suspended from the pendant member 52. Furthermore, there is a stop means 83 illustrated as a cylindrical groove having one end 85 which tends to limit the oscillation of the stem and thereby the suspended vane, louver or slat 5.

Figure 7:
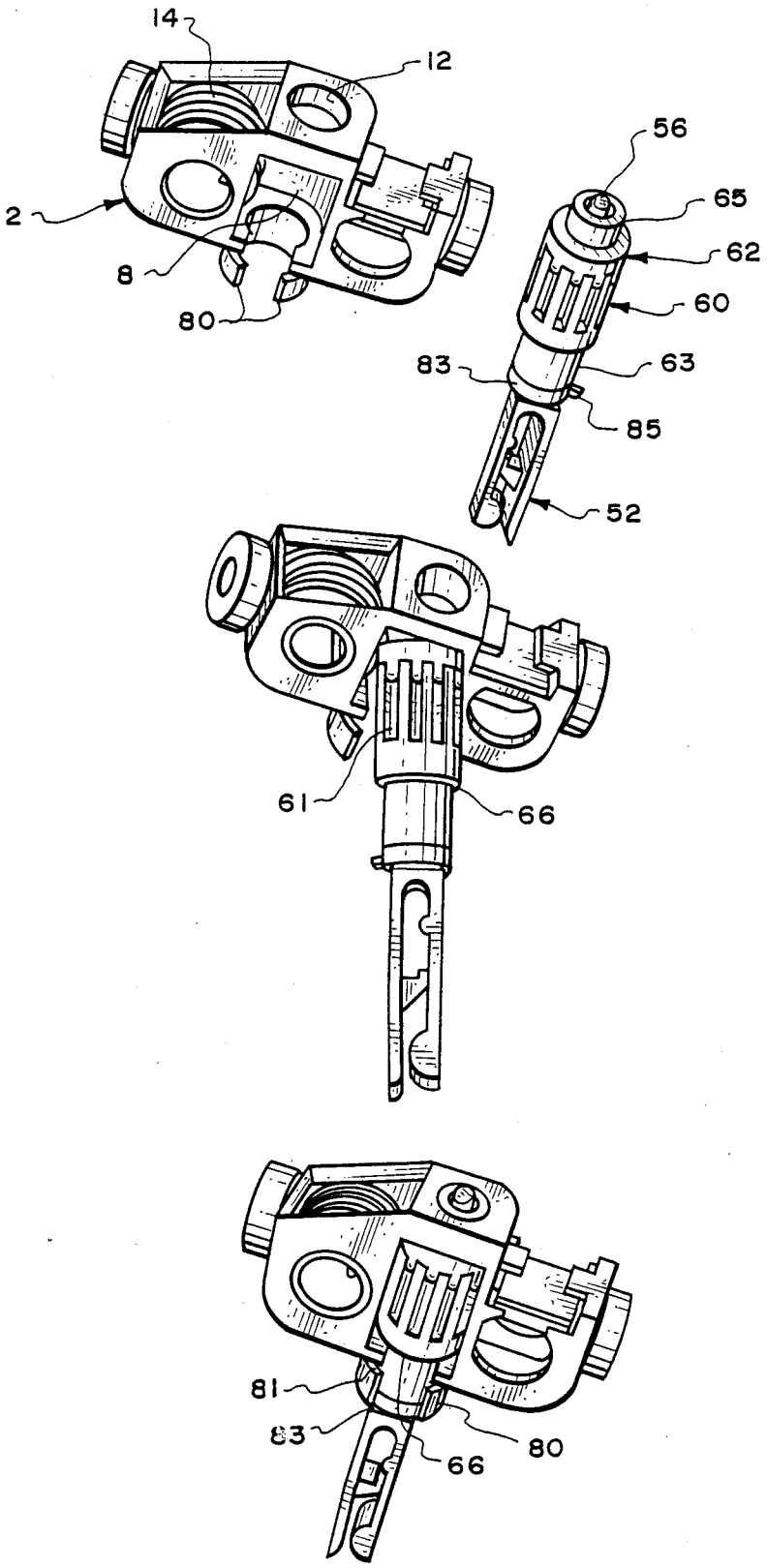
FIG. 7 shows the three steps by which the cartridge hanger 6 assembly snaps in place in the chamber in the carrier.

FIG. 7 indicates the three steps which must be completed in succession in order to manually insert the cartridge hanger assembly 50 into the frame means 2. The illustration of FIG. 7 shows the vertical cavity 8 with the retaining clip 80 in view. The circular bearing 12 is also illustrated. The two items, that is, the vertical bearing 12 and the retaining clip 80 are both aligned on the same vertical axis. The circular top 65 of the assembly is loaded into the vertical cavity first as shown in the middle figure illustration of FIG. 7. The circular top 65 mates with the circular bearing means 12 and simultaneously the body of the cartridge assembly 50, and in particular, the cylindrical portion 63 of the stem gear is matched up with the retaining clip 80 and pushed in transversely causing the retaining clip 80 to expand to allow the cartridge to enter the vertical cavity. At the same time, the gear spaces 61 on the stem gear 60 cooperate and match up with the gears on the worm gear 14 so that the end result is shown in the bottom illustration of FIG. 7. The cartridge assembly 50 is securely held in place because of the circular top 65 which mates with the circular bearing 12, and the cylindrical journal 63 portion on the stem gear which mates with the retaining clip 80. The cartridge assembly 50 cannot become disengaged or fall out of position, because the retaining edge 81 of the retaining clip 80 stops the middle edge 66 of the stem gear thereby preventing the cartridge assembly 50 from dropping out. This can be seen in the bottom illustration of FIG. 7. After the cartridge assembly 50 has been inserted into the frame 2, the carrier and hanger assembly functions in the conventional way. That is, that the series of vertical carrier assemblies are positioned on a railhead. The pinion rod 1 passes through each worm gear in each carrier assembly allowing for all of the vertical louvers or vanes to be rotated about their vertical axes the same number of degrees whenever the pinion rod is rotated.

There is a further adjustment means comprising part of this invention and it has to do with the ability to change the vertical orientation of a vertical louver or vane along its vertical axis independently of the other vertical louvers or vanes forming the vertical blind system. This is accomplished by the pendant member 52. When torque is applied to the pendant member 52, the teeth 67 in the toothed crown ring 62 flex and disengage themselves from the tooth spaces 61 at the top of the stem gear 60. The bulbous tip 56 at the end of the pendant member in combination with the pair of secant flats 58 precludes the toothed crown ring 62 from rotating independently of the vertical stem 54. The resilient and elliptical shaped radial passage 64 of the toothed crown ring locks the toothed crown ring into position relative to the vertical stem 54. That is why when the pendant member is twisted, the toothed crown ring also twists relative to the stem gear 60. There is enough resiliency in the downwardly projecting teeth and also there is enough of a gap or clearance between the stem gear and the cylindrical groove 83 to allow the toothed crown ring 62 to temporarily disengage itself from the stem gear and allow the pendant member to be rotated and then reengaging the downwardly projecting teeth 67 with the gear spaces or lands 61 in the stem gear to lock in the new vertical orientation of the vane relative to the other vanes. The readjustment capability of each vertical vane allows the occupant of the room in which the vertical blind system has been installed to adjust each vane as he or she chooses to block out the sunlight or for privacy. In the present invention, the breakage of the pendant member, or stem clip presents only a minor problem, because the service technician can easily remove the cartridge assembly 50 and replace it with a new one. This is accomplished by removing the vertical blind from the pendant member and pulling outwardly on the pendant member area thereby causing the retaining clip to expand and release the cylindrical journal 63 from its grasp. At the same time, the circular top of the toothed crown ring disengages itself from the circular bearing 12. The installation steps are the reverse of the removal steps. The broken assembly is discarded and a new replacement assembly is snapped back in place as previously discussed. The vertical louver is reinserted and the job is done —all in a few seconds.

Figure 1:
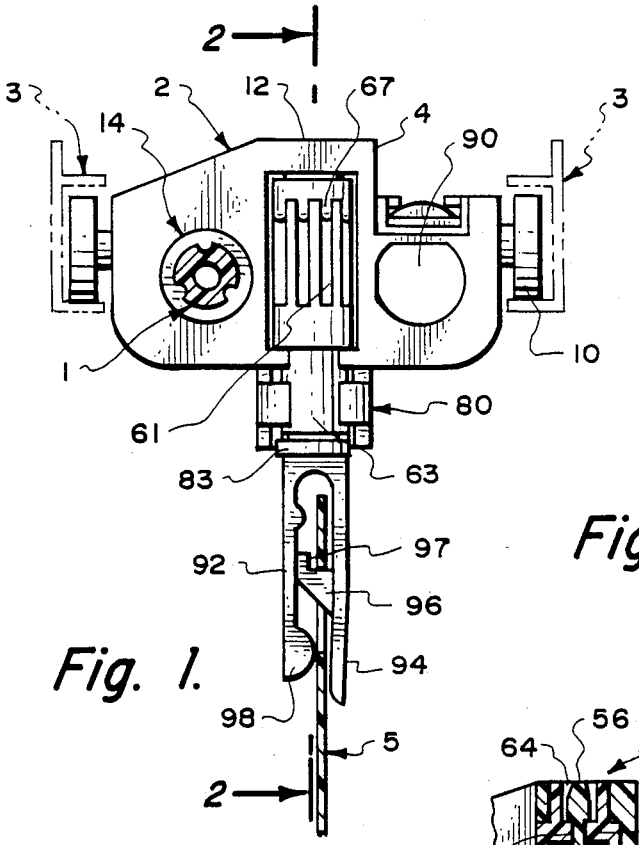
FIG. 1 is a front elevational view of the support carrier and the snap-in cartridge hanger assembly unit.
Figure 4:
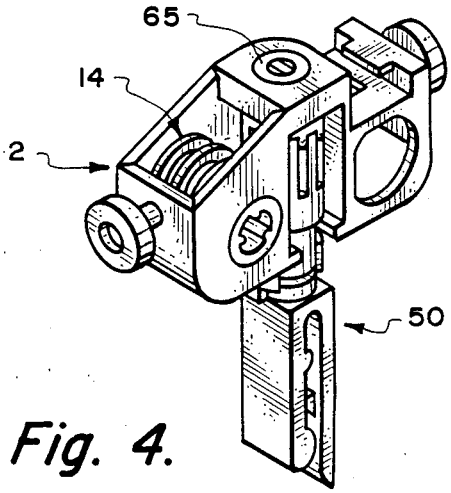
FIG. 4 is a perspective view of the carrier and hanger assembly unit.

FIG. 5 also shows the frame 2 separate from the cartridge assembly 50. The two-pointed arrow indicates the proper positioning of the two when they are combined with one another. FIG. 4 shows the entire carrier assembly in place. The front elevational view in FIG. 1 shows both sides of the rail head 3 having the wheels 10 running along the tracks of this railhead. There is also shown the pinion rod 1 which mates with the central bore 16 of the worm gear. This view clearly illustrates the structure of the elongate pendant member 52. There is shown the pair of fingers 92 and 94. The boss 98 is disclosed and the ledge 96 is also disclosed. The resilient open retaining clip 80 is shown having its pair of arms extending around the cylindrical journal 63. The downwardly projecting teeth 67 of the toothed crown ring 62 are shown mating with the tooth spaces or lands 61 on the stem gear 60.

Figure 2:
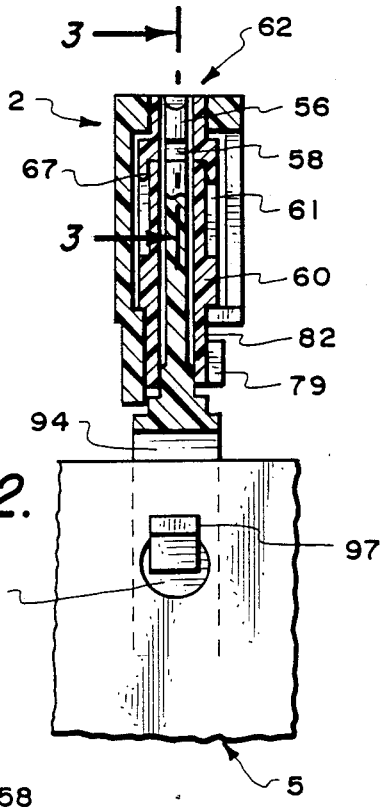
FIG. 2 is an elevational view of the carrier and hanger assembly unit in cross section.
Figure 3:
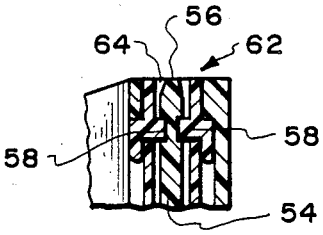
FIG. 3 is a side elevational view taken along the lines 3—3 of FIG. 2.

FIG. 6 illustrates the cylindrical groove 83 which has an end 85 allowing the elongate pendant member to oscillate within a certain range. The end 85 allows rotational movement of the vane about 180 degrees, which is limited because the retaining clip has a cutaway lower portion which allows the end 85 to oscillate between the cutaway portion. This limitation on the oscillation range of the louver is designed to allow the adjacent louvers to come into complete contact with each other; otherwise excessive light would be admitted when the blind system is closed. Because of the ¼ inch overlapping of the vanes on each side, there is no way they can damage each other by touching. FIG. 1 also shows a circular passageway 90 as part of the frame 2. This passageway allows for cords and other connecting drawstrings so that the array of hanger assemblies can be drawn out or drawn in along the railhead 10. FIG. 2 shows a vertical cross-section taken along the lines 2—2 of FIG. 1. FIG. 2 further shows the vertical cavity 8, one of the secant flats 58, the cross-section of the stem gear showing the downwardly projecting teeth 67 in the crown ring mating with the tooth spaces or lands 61 of the stem gear and the portion of the cylindrical journal. The finger 94 is shown in phantom lines having the ledge 96 projecting forward and the louver slot 7 hung on this ledge and a portion of the vane is also illustrated in this view. FIG. 3 further shows a more detailed illustration on how the toothed crown ring 62 mates with the vertical stem 54 and the stem gear 60. Clearly shown in FIG. 3 are the two secant flats 58 cutaway from the vertical stem 54 and below the bulbous tip 56. The enlarged end 56 is called a bulbous tip. The elliptical shaped radial passage 64 of the crown ring 62 is shown after it has been slipped over the bulbous tip 56. The upper portion of the elliptical shaped radial passage 64 is actually circular in configuration. It is the lower portion shown in FIG. 3 which has the elliptical shaped lower passage. This elliptical shaped passage mates with the secant flats 58 so that the crown ring itself is immobile relative to the vertical stem 54. The bulbous tip is resilient enough and so is the toothed crown ring such that the bulbous tip will pass through the elliptical radial and then expand itself back up into the circular cavity passageway radial passage 64 so that neither the bulbous tip 56 nor of the radial passage 64 is in a stressed position after the toothed crown ring is snapped into place over the bulbous tip 56. The downwardly projecting teeth of the crown ring are shown resting comfortably in each space 61 between the gear teeth on the stem gear 60. The spaces are also clearly shown in FIG. 1. Again, there is sufficient clearance between the bottom of the circular journal 63 and the cylindrical groove 83 such that the pendant member 52 can be pushed upwardly and rotated so that the teeth 67 will disengage themselves from the teeth spaces 61 of the stem gear allowing the orientation of the pendant member to be individually adjusted. The stem gear 61 cannot rotate because its teeth are meshed with the teeth of the worm gear. Unless the worm 88 gear is rotated, the stem gear cannot be rotated. The frame 2, the pinion gear 1, the worm gear 14 and the stem gear 61 are all stationary relative to one another. If the orientation of the pendant member needs to be adjusted because the louver hanging from it needs to be adjusted, then rotation by applying torque to the pendant member will allow or force the downwardly projecting teeth on the crown ring to disengage with the tooth spaces or lands of the vertical stem gear thereby permitting the pendant member to be rotated within the confines of that allowed by end 85 of the cylindrical groove 83. After the adjustment has been completed, the bending of the downwardly projecting teeth on the crown rings will force the teeth to realign themselves and to be lodged into the teeth spaces of the stem gear. There is a limited clearance between the bottom of the toothed crown ring and the top of the stem gear. The clearance becomes apparent when the pendant member is twisted. Each tooth space in the stem gear has a corresponding downwardly projecting tooth from the toothed crown ring. Although this is not critical to the invention, it tends to give the best contact to prevent inadvertent change in the orientation of the vane. This combination of the toothed crown ring, the stem gear and the bulbous tip of the pendant member cooperating to engage and disengage upon twisting of the pendant member could be described as a clutch mechanism in that the rotation of the pendant member causes a clicking noise as the teeth of the crown ring move one notch, that is a tooth space, on the stem gear and the clicking basically amounts to a 40 degree rotational change of attitude of the vertical louver for each click heard when turning the pendant member.

While the present invention has been shown and described herein in what is conceived to be the best mode contemplated, it is recognized that departures may be made therefrom within the scope of the invention which is therefore not to be limited to the details disclosed herein, but is to be afforded the full scope of the invention.

What is claimed is:

1. A carrier and a manually insertable snap-in replaceable cartridge hanger assembly for a vertical louver or vane, comprising:

frame means having a top surface, a bottom surface, and a vertical cavity and adapted to slide horizontally along a splined pinion rod;

worm gear means rotatably mounted on said frame means and having a central bore through which the pinion rod is adapted to pass;

a manually insertable snap-in cartridge hanger assembly for mounting in said cavity of said frame means;

said cartridge hanger assembly allowing for quick replacement of a broken cartridge hanger assembly with a new one;

a circular bearing means in said top surface of said frame means for acting as an anchoring point for one end of said snap-in cartridge hanger assembly;

a resilient open retaining clip axially aligned below said circular bearing means and attached to said bottom surface of said frame means for maintaining said snap-in cartridge hanger assembly in proper alignment in said cavity of said frame means;

said manually insertable snap-in replaceable cartridge hanger assembly further comprising:

vertical stem means;

a stem gear having a lower cylindrical journal portion rotatably mounted on said stem means having a vertical axial bore and mating with said worm gear means; said cylindrical journal portion of said stem gear being axially aligned as part of said stem gear for cooperating with said open retaining clip;

said vertical stem means passing rotatably through said stem gear bore;

securing means on the lower portion of said stem means for holding a vertical blind;

a toothed crown ring having an elliptical shaped radial passage and secured to said stem means above said stem gear, having at least one tooth projecting downward and selectively engageable with a tooth space of said stem gear, said crown of said crown ring cooperating with said circular bearing in said frame means;

said stem means having an enlarged end for stationary securing said toothed crown ring to said stem means.

2. A carrier and a hand insertable snap-in replaceable cartridge hanger assembly for a vertical louver or vane comprising: frame means having a chamber and adapted to slide horizontally along a splined pinion rod; worm gear mans rotatably mounted in said frame means and having a central bore through which the pinion rod is adapted to pass; a hand insertable snap-in replaceable cartridge means for insertion in said chamber;

said snap-in cartridge means includes:

vertical stem means;

a stem gear having vertically oriented teeth and spaces between said teeth and rotatably mounted on said stem means and having a vertical axial bore and mating with said worm gear means;

said vertical stem means passing and being rotatable within through said stem gear bore;

securing means on the lower portion of said vertical stem means for holding a vertical louver or vane;

a toothed crown ring having a circular top and an elliptically shaped radial passage and secured to said stem means above said stem gear and having at least one tooth projecting downwardly and selectively engageable with at least one said tooth space of said stem gear;

said vertical stem means having an enlarged end for securing said toothed crown ring;

said components in said replaceable cartridge capable of cooperating with one another for forming a clutch means for allowing the angular orientation of a hanging louver or vane to be rotationally adjusted incrementally and independently of the orientation of the other hanging louvers or vanes;

during said rotational adjustment, said clutch means emits an audible clicking noise to indicate to the user that the hanging louver or vane has been rotationally turned one increment;

means for demountably securing said cartridge means in said chamber of said frame means for quick replacement of a damaged cartridge means with an undamaged one which includes an integrated circular bearing surface means and a resilient retaining clip on said frame means;

a cylindrical journal axially aligned between said stem gear and said lower end of said vertical stem means for cooperating with said resilient retaining clip for demountably securing said snap-in cartridge means in place in said chamber;

said circular top of said crown ring cooperating with said circular bearing surface of said frame means for demountably securing said snap-in cartridge means in place in said chamber.

3. The device in accordance with claim 2, wherein:

said enlarged end of said stem means includes a bulbous tip;

said stem means having secant flats grooved therein on opposite sides of said stem means, spaced axially inward from the end of said stem means and said bulbous tip;

said elliptical shaped radial passage of said crown ring being sufficiently temporarily expandable to slip over said bulbous tip of said stem when forced over said tip to secure said toothed crown ring to said stem means by preventing said ring from slipping off said bulbous tip;

said elliptical shaped radial passage and said secant flats mating to secure said crown ring to said stem means and to prevent it from rotating on said stem means;

4. The device in accordance with claim 1 wherein said securing means includes an elongate pendant member made of resilient material and having a longitudinal slot forming a pair of parallel fingers;

one of said fingers having a ledge extending substantially across said slot, and an upwardly extending ridge on the edge of said ledge adjacent to said other finger;

the other of said fingers having a boss extending into said slot below said ledge;

whereby a vertical louver or vane having a slot may be inserted into the slot in said member and said louver slot hooked over and behind said ridge and thus held in place suspended from said member.

5. Carrier in accordance with claim 2, including stop means for limiting the rotation of said stem means.

6. The carrier and hanger assembly as recited in claim 2 wherein said vertical stem gear and cylindrical journal are integrated as a single unit, said journal being positioned below said teeth of asid stem gear.

7. A carrier and a hand insertable snap-in replaceable cartridg ehanger assembly for a vertical louver or vane comprising:

frame means having a chamber and adapted to slide horizontally along a splined pinion rod;

worm gear means rotatably mounted in said frame means and having a central bore through which the pinion rod is adapted to pass;

a hand insertable snap-in replaceable cartridge means for insertion in said chamber;

said snap-in cartridge means includes:

vertical stem means;

a stem gear having vertically oriented teeth and spaces between said teeth and rotatably mounted on said stem means and having a vertical axial bore and mating with said worm gear means;

said vertical stem means passing rotatably through said stem gear bore;

securing means on the lower portion of said vertical stem means for holding a vertical louver or vane;

a toothed crown ring having a circular top and an elliptically shaped radial passage and secured to said stem means above said stem gear and having at least one tooth projecting downwardly and selectively engageable with at least one said tooth space of said stem gear;

said vertical stem means having an enlarged end for securing said toothed crown ring;

said components in said replaceable cartridge capable of cooperating with one another for forming a clutch means for allowing the angular orientation of a hanging louver or vane to be rotationally adjusted incrementally and independently of the orientation of the other hanging louvers or vanes;

said clutch means is formed by said downwardly projecting teeth of said toothed crown ring permanently engaging with said tooth spaces on said stem gear and sufficient clearance between the bottom of said cylindrical journal and said securing means on said lower portion of said vertical stem means such that when sufficient torque is applied to the hanging louvre, or said vertical stem means, that said teeth of said toothed crown ring will flex like a spring and ride up over the top end of said stem gear allowing said downwardly projecting teeth of said toothed crown ring to temporarily disengage from said stem gear and unflex like a spring and reengage with the stem gear after rotating one tooth space on said stem gear causd by said temporarily flexed teeth unflexing by their spring action and reengaging with said tooth spaces on said stem gear thereby resulting in changing the angular orientation of a hanging louvre about its vertical axis;

during said rotational adjustment, said clutch means emits an audible clicking noise to indicate to the user that the hanging louver or vane has been rotationally turned one increment;

means for demountably securing said cartridge means in said chamber of said frame means for quick replacement of a damaged cartridge means with an undamaged one which includes an integrated circular bearing surface means and a resilient retaining clip on said frame means;

a cylindrical journal axially aligned between said stem gear and said lower end of said vertical stem means for cooperating with said resilient retaining clip for demountably securing said snap-in cartridge means in place in said chamber;

said circular top of said crown ring cooperating with said circular bearing surface of said frame means for demountably securing said snap-in cartridge means in place in said chamber.

* * * * *